US008920145B2

(12) United States Patent
Brown

(10) Patent No.: US 8,920,145 B2
(45) Date of Patent: Dec. 30, 2014

(54) SYNCHRONIZED HYDRAULIC POWER MODULE

(75) Inventor: David W. Brown, Niles, MI (US)

(73) Assignee: GTA Innovation, LLC, South Bend, IN (US)

( * ) Notice: Subject to any disclaimer, the term of this patent is extended or adjusted under 35 U.S.C. 154(b) by 870 days.

(21) Appl. No.: 13/116,655

(22) Filed: May 26, 2011

(65) Prior Publication Data

US 2012/0134855 A1 May 31, 2012

Related U.S. Application Data

(60) Provisional application No. 61/417,879, filed on Nov. 29, 2010.

(51) Int. Cl.

| | |
|---|---|
| ***F04B 23/04*** | (2006.01) |
| ***F01B 9/00*** | (2006.01) |
| ***F15B 7/08*** | (2006.01) |
| *F15B 11/22* | (2006.01) |

(52) U.S. Cl.
CPC .. *F15B 7/08* (2013.01); *F15B 11/22* (2013.01)
USPC ..... 417/521; 417/531; 92/136

(58) Field of Classification Search
USPC ..... 417/521, 531; 92/136; 91/533
See application file for complete search history.

(56) References Cited

U.S. PATENT DOCUMENTS

| | | | | |
|---|---|---|---|---|
| 1,959,240 | A * | 5/1934 | Josky | 152/214 |
| 2,476,481 | A * | 7/1949 | Cunniff | 417/486 |
| 2,499,563 | A * | 3/1950 | Bill | 60/547.1 |
| 3,625,115 | A | 12/1971 | Tani et al. | |
| 3,769,881 | A | 11/1973 | Aoki | |
| 3,771,918 | A * | 11/1973 | Winter | 417/266 |
| 3,776,300 | A | 12/1973 | Fismer | |
| 4,241,581 | A | 12/1980 | Chace | |
| 4,251,993 | A | 2/1981 | Vancil | |
| 4,343,226 | A | 8/1982 | Ribeiro de Almeida | |
| 4,351,153 | A * | 9/1982 | Kosmala | 60/581 |
| 4,373,334 | A * | 2/1983 | Carlander | 60/594 |
| 4,409,884 | A | 10/1983 | Boehringer | |
| 4,500,071 | A | 2/1985 | Bagwell et al. | |
| 4,671,745 | A * | 6/1987 | Smith | 417/419 |
| 4,706,458 | A | 11/1987 | Corghi | |
| 4,777,798 | A | 10/1988 | Jacobson et al. | |
| 4,825,748 | A | 5/1989 | Sheng | |
| 5,065,844 | A | 11/1991 | Hon | |
| 5,110,251 | A | 5/1992 | Gray | |
| 5,139,110 | A | 8/1992 | Kishi | |
| 5,141,112 | A * | 8/1992 | Holbert | 209/653 |
| 5,311,808 | A | 5/1994 | Ando | |
| 5,819,632 | A * | 10/1998 | Moody | 91/519 |
| 6,026,934 | A | 2/2000 | Deurloo | |
| 6,029,450 | A | 2/2000 | Wittich | |
| 6,408,736 | B1 | 6/2002 | Holt et al. | |
| 6,568,897 | B2 | 5/2003 | Kendall | |
| 6,624,126 | B1 | 9/2003 | Kasuga et al. | |

(Continued)

*Primary Examiner* — Charles Freay
(74) *Attorney, Agent, or Firm* — Babcock IP, PLLC

(57) ABSTRACT

A hydraulic power module is provided with a plurality of hydraulic actuators. A piston of each of the hydraulic actuators is coupled with a drive plate and a screw is rotatably coupled with the drive plate. Rotation of the screw longitudinally displaces the drive plate to simultaneously actuate each of the hydraulic actuators. A second hydraulic power module may be coupled with the hydraulic power module, such that rotation of the screw also drives the screw of the second hydraulic power module.

18 Claims, 9 Drawing Sheets

(56) References Cited

U.S. PATENT DOCUMENTS

| | | | | |
|---|---|---|---|---|
| 6,637,314 | B2 * | 10/2003 | Nagai et al. | 92/136 |
| 6,666,129 | B1 * | 12/2003 | Schmid et al. | 92/136 |
| 7,047,738 | B2 | 5/2006 | Bair | |
| 7,073,631 | B2 | 7/2006 | Ludwig et al. | |
| 7,134,280 | B2 | 11/2006 | Bair | |
| 7,198,135 | B2 | 4/2007 | Naber | |
| 7,269,949 | B1 | 9/2007 | Petricio Yaksic | |
| 7,299,897 | B2 | 11/2007 | Stockmann | |
| 7,322,190 | B2 | 1/2008 | Bair | |
| 7,685,927 | B1 | 3/2010 | Hanser et al. | |
| 7,770,868 | B2 | 8/2010 | Koop | |
| 8,496,302 | B2 * | 7/2013 | Fukushima | 303/114.1 |
| 2010/0111721 | A1 * | 5/2010 | Servin et al. | 417/321 |

* cited by examiner

SYNCHRONIZED HYDRAULIC POWER MODULE

CROSS-REFERENCE TO RELATED APPLICATIONS

This application claims the benefit of U.S. Provisional Patent Application No. 61/417,879, titled "Synchronized Hydraulic Power Module and Lift System", filed by David W. Brown on Nov. 29, 2010 hereby incorporated by reference in its entirety.

BACKGROUND

1. Field of the Invention

This invention relates to a synchronized hydraulic power module. More particularly, the invention relates to a hydraulic power module capable of providing equal hydraulic pressure to a plurality of hydraulic lines.

2. Description of Related Art

Two or more hydraulic actuators may be used in concert for moving or lifting objects. For example, a platform or other object may be raised or lowered via synchronized piston movement of multiple hydraulic actuators. Synchronized actuation typically requires delivery of an equal amount of hydraulic pressure via a plurality of hydraulic lines, one for each hydraulic actuator. Typical devices for providing equal pressure to multiple hydraulic actuators have focused on balancing hydraulic pressure applied to multiple hydraulic actuators received from a common hydraulic pressure source, such as a hydraulic pump and hydraulic fluid delivery/circulation system.

Conventional hydraulic pumps generate hydraulic pressure via rotation of vanes, meshed screw surfaces, gears, reciprocating pistons or the like. Depending upon the desired operating characteristics, these hydraulic pumps may require high tolerance manufacture of a plurality of complex impeller and housing elements from high strength metal alloys, significantly increasing the overall cost of the hydraulic system. Further, these types of hydraulic pumps may require frequent specialized maintenance and/or part exchange procedures for continued operation.

Conventional hydraulic fluid delivery/circulation systems include a circulation loop. This necessitates various support piping, pressure relief and hydraulic reservoir errata, increasing the system complexity and cost of manufacture. Further, the complexity of conventional hydraulic systems introduces a significant number of possible failure points, any one of which may render the entire system inoperable. Hydraulic pressure supply systems may also often utilize continuous drive motor operation to ensure hydraulic pressure is available on-demand, due to reliance upon centrifugal force and/or a leakage characteristic of the pump elements. Continuous operation of the drive motor may consume significant energy, further increasing overall system operation costs.

Prior solutions have utilized, for example, a plurality of hydraulic actuators actuated by an equal number of master hydraulic actuators provided in a unitary monolithic actuator housing, with the master hydraulic actuators simultaneously actuated by a pneumatic cylinder. Manufacture of a unitary monolithic actuator housing for multiple pistons may require numerous precision machining steps, increasing material waste, manufacturing complexity and overall costs. Further, utilizing pneumatic pressure requires an additional pneumatic pressure supply/storage system also of similar significant complexity and cost.

Therefore, it is an object of the invention to provide a hydraulic power module and method of manufacture that overcomes deficiencies in such prior art.

BRIEF DESCRIPTION OF THE DRAWINGS

The accompanying drawings, which are incorporated in and constitute a part of this specification, illustrate embodiments of the invention, together with a general description of the invention given above, and the detailed description of the embodiments given below, serve to explain the principles of the invention. Like reference numbers in the drawing figures refer to the same feature or element and may not be described in detail for every drawing figure in which they appear.

DETAILED DESCRIPTION

The inventor has recognized that many conventional hydraulic power systems fail to provide consistent and reliable synchronization of multiple hydraulic actuators. Those hydraulic power systems that do attempt to provide equal power to multiple hydraulic actuators are more complicated than necessary and/or less reliable than desirable. The inventor has further recognized that it is possible to overcome these difficulties by providing a hydraulic power module without a hydraulic pump and/or hydraulic fluid circulation loop.

Figure 1:
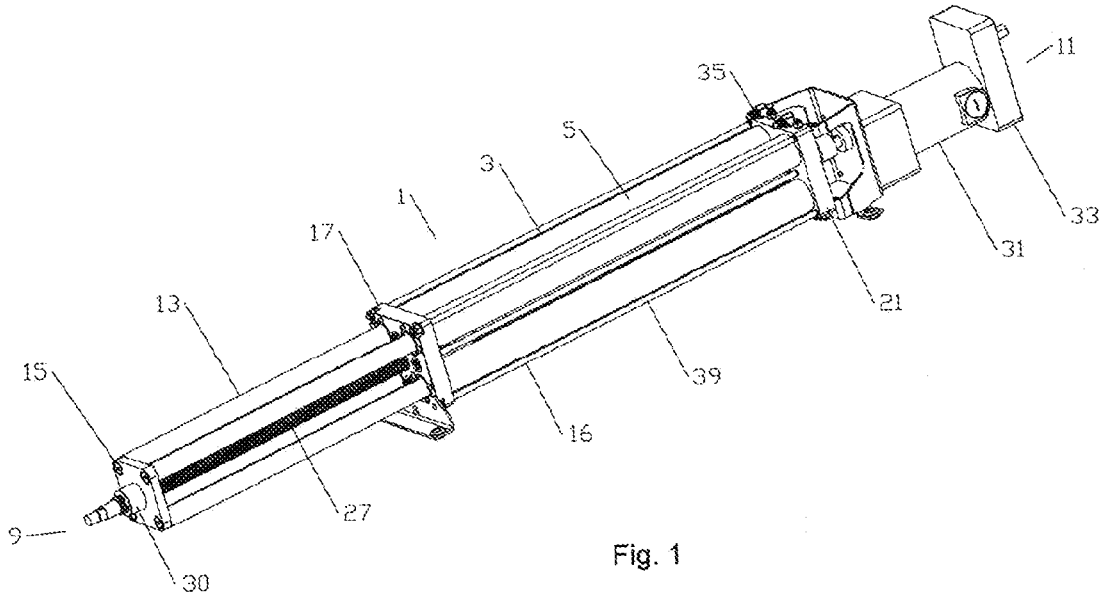
FIG. 1 is a schematic isometric angled side view of an exemplary hydraulic power module demonstrated with an electric motor and a reduction gear.
Figure 2:
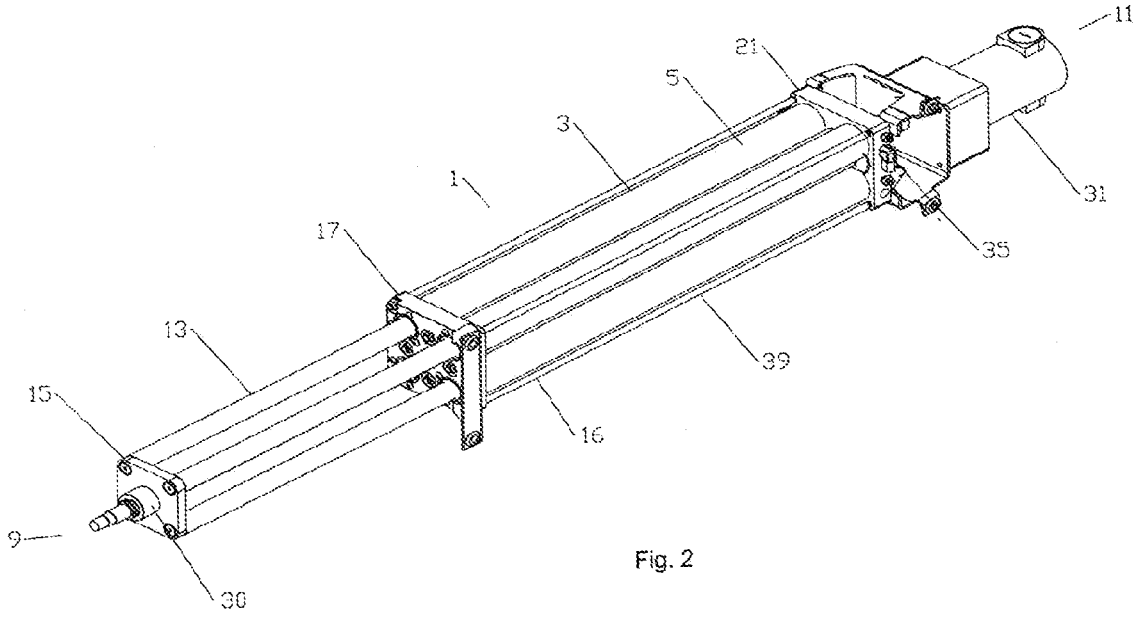
FIG. 2 is a schematic isometric angled bottom view of the hydraulic power module of FIG. 1, without a reduction gear.
Figure 3:
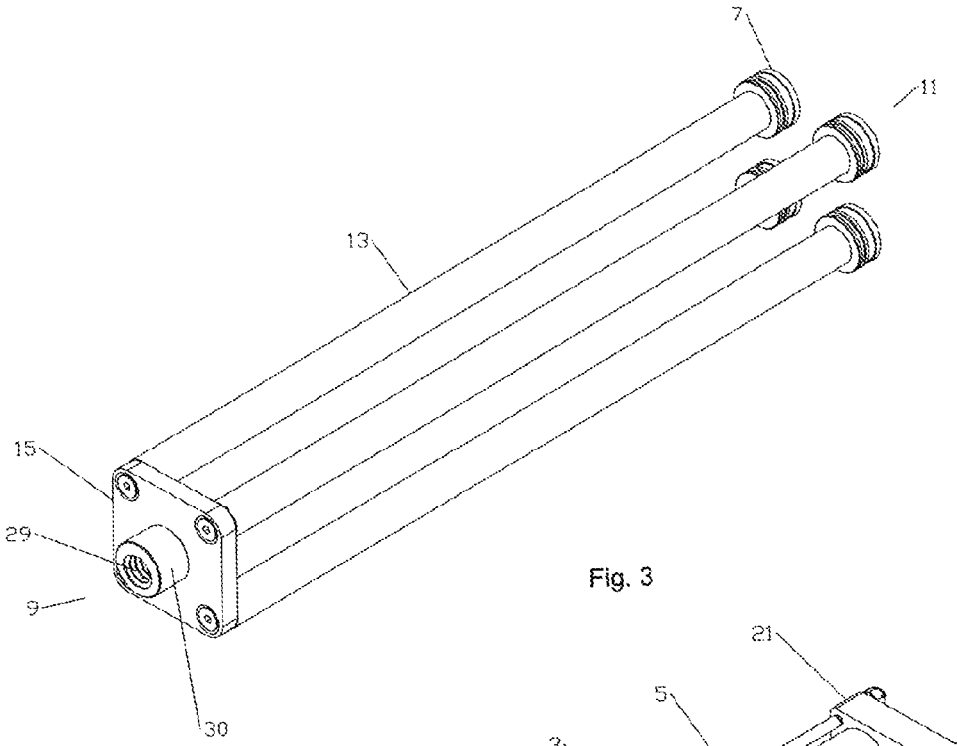
FIG. 3 is a schematic isometric view of the drive plate, shafts and pistons of the hydraulic power module of FIG. 1.

A first exemplary embodiment of a hydraulic power module 1 is demonstrated in FIGS. 1-7. As best shown in FIGS. 1-2, the hydraulic power module 1 is provided with a plurality of hydraulic actuators 3. Each hydraulic actuator comprises a cylinder 5 paired with a piston 7. As best shown in FIG. 3, a first end 9 of each piston 7 may be coupled with a second end 11 of a shaft 13. Alternatively, a monolithic piston 7 may include an integral shaft portion.

One skilled in the art will appreciate that the first end 9 and the second end 11 are applied herein as identifiers for respective ends of both the hydraulic power module 1 and the discrete elements of the hydraulic power module 1 to identify same and their respective interconnecting surfaces according to their alignment along a longitudinal axis of the hydraulic power module 1 between the first end 9 and the second end 11.

A hydraulic chamber is formed within each cylinder 5 between the piston 7 and the base plate 21. As the piston 7 moves longitudinally back and forth within the cylinder 5, hydraulic pressure is increased or decreased, enabling the actuation or release of a remote hydraulic actuator coupled with the hydraulic chamber.

A first end 9 of each of the shafts 13 may be coupled with a drive plate 15. The drive plate 15 provides a unified driving surface for each of the pistons 7 with respect to a screw 27 threadably coupled to the drive plate 15.

Figure 4:
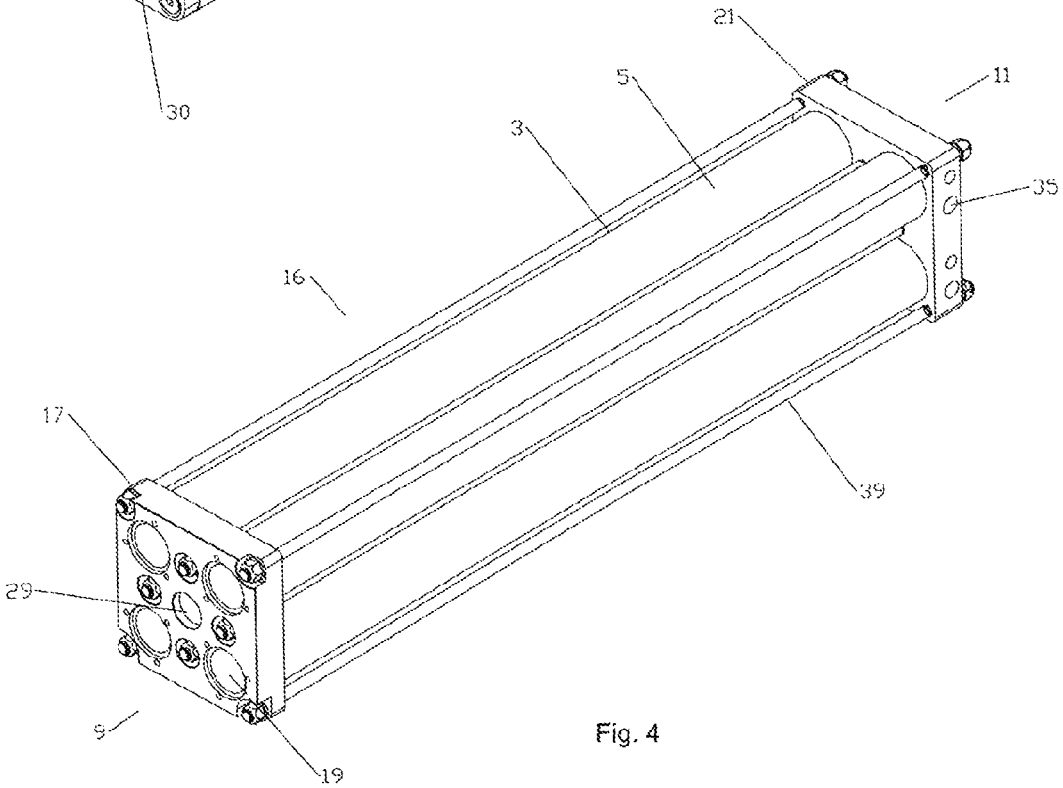
FIG. 4 is a schematic isometric view of the actuator housing assembly of FIG. 1.

The pistons 7 each slidably couple with a cylinder 5 of an actuator housing assembly 16, best shown in FIG. 4. The actuator housing assembly 16 may be formed from a plurality of cylinders 5 retained between a connection plate 17 and a base plate 21.

Figure 5:
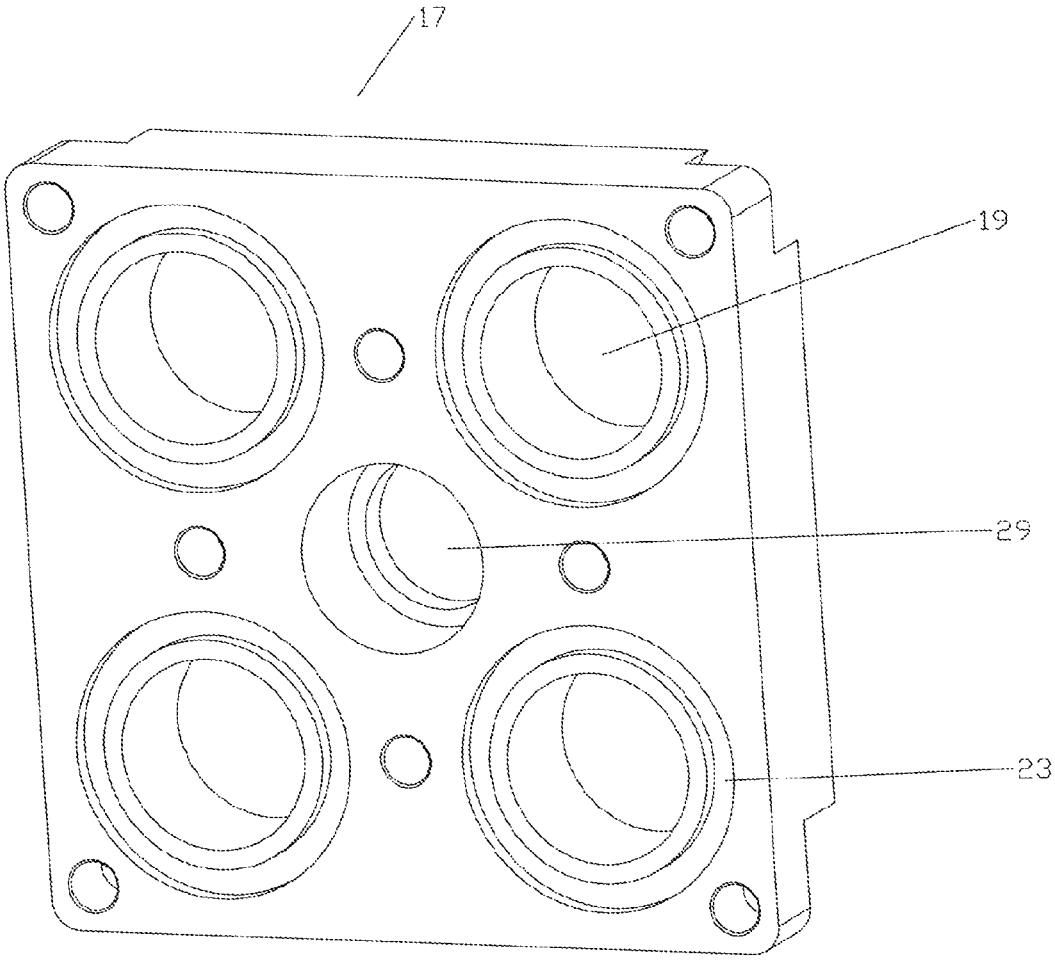
FIG. 5 is a schematic isometric view of the connection plate of the actuator housing assembly of FIG. 4.

The connection plate 17, best shown in FIG. 5, may be provided with a plurality of connection plate cylinder grooves 23. The first end 9 of each of the cylinders 5 may be seated against the connection plate cylinder grooves 23. Similarly, the base plate 21, best shown in FIG. 6, may be provided with a plurality of base plate cylinder grooves 25. The second end 11 of each of the cylinders 5 may be seated against the base plate cylinder grooves 25. Seals seated in the connection plate cylinder grooves 23 and cylinder grooves 25, such as an o-ring or the like, may be applied to enhance a seal between each the respective ends of each cylinder 5 and the connection plate 17 and the base plate 21.

The actuator housing assembly 16 may be retained together via, for example, a plurality of compression bolts 39 extending between the connection plate 17 and the base plate 21. The compression bolts 39 may retain the connection plate 17 and the base plate 21 with the cylinder 5 therebetween via a threading into one of the connection plate 17 and the base plate 21 or application of a nut or the like. For permanently assembled construction, the compression bolt 39 may be welded in place. Alternatively, the joints between each end of the cylinder 5 and the connection plate 17 and/or the base plate 21 may be retained, for example via one or more welded and/or threaded interconnections.

Figure 6:
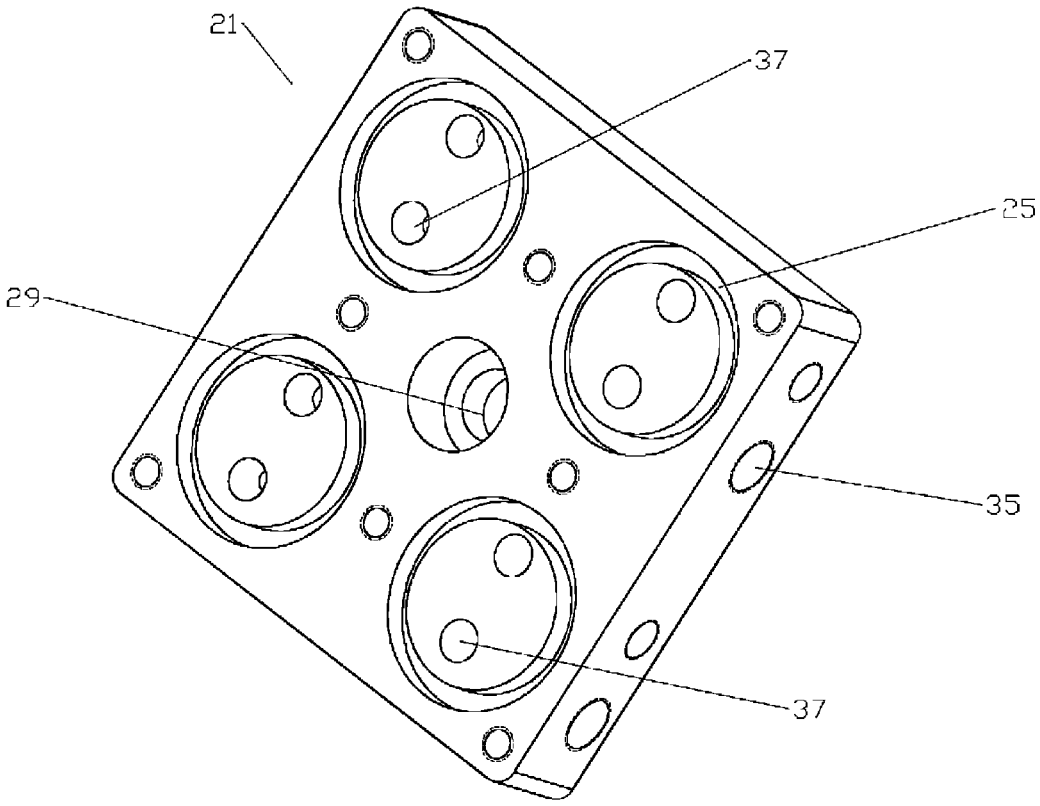
FIG. 6 is a schematic isometric view of the base plate of the actuator housing assembly of FIG. 4.
Figure 7:
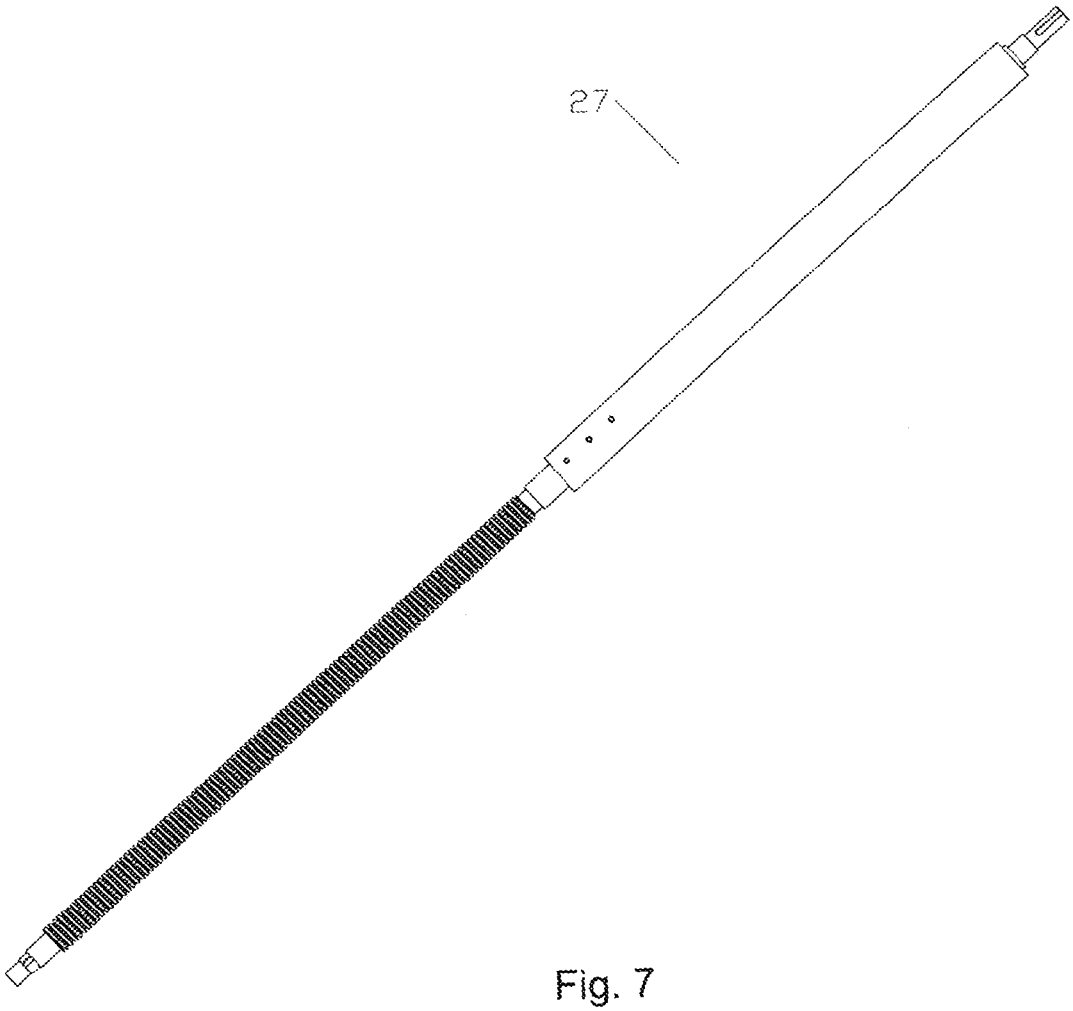
FIG. 7 is a schematic isometric view of the screw of the hydraulic power module of FIG. 1.

Rotation of the screw 27, best shown in FIG. 7, drives the drive plate 15 longitudinally along the screw 27 and thus the piston 7 along their respective cylinder 5 to simultaneously actuate each of the hydraulic actuators 3. The drive plate 15, the connection plate 17 and the base plate 21 may each be provided with a screw aperture 29, as best shown in FIGS. 3, 5 and 6, respectively. The screw 27, accordingly, may be inserted through the screw aperture 29 of the drive plate 15, the connection plate 17 and the base plate 21. At least a portion of the screw 27 may be provided with threading. The entire length of the screw 27, however, need not be threaded.

The coupling of the screw 27 with the drive plate 15 may be provided by application of threads directly to the screw aperture 29, the threads dimensioned to threadably couple with the screw 27. Alternatively, a drive nut 30 with the threads thereon may be coupled with the drive plate 15, for example as shown on FIG. 3. In the alternative, one skilled in the art will appreciate that an equivalent arrangement may be realized by threadably coupling the base plate 21 to the screw 27, rotation of the screw 27 thereby driving the actuator housing assembly 16 toward or away from the drive plate 15 to actuate the hydraulic actuators 3.

The screw 27 may be rotated, for example, via an electric motor 31 coupledwith the base plate 21. Selection of an electric motor 31 with a high torque characteristic can assist the starting and stopping of the screw 27 rotation under load from the hydraulic actuators 3. Alternatively, an electric motor 31 for rotating the screw may be coupled with the drive plate 15. The screw 27 may also be manually rotated via a reduction gear 33 coupled, for example, with the second end 11 of the electric motor 21. Alternatively, a reduction gear 33 could be coupled with either the drive plate 15 or the base plate 21. The hydraulic power module 1 may be provided with either an electric motor 32 or a reduction gear 33, or both, as shown for example in FIG. 1.

Each of the cylinders 5 may be coupled with an output port 35. The coupling of each cylinder 5 and output port 35 may, for example, be provided via one of a plurality of output port apertures 37 of the base plate 21. Synchronized actuation of the hydraulic actuators 3, via rotation of the screw 27, produces an equal flow of hydraulic power through each of the output ports 35 to hydraulic lines coupled thereto.

As best shown in FIGS. 1 and 2, to improve durability and stability, and to avoid unbalanced loads, the plurality of hydraulic actuators 3 may be arranged symmetrically around the screw 27. To further increase strength characteristics, durability and/or stability, the compression bolt 39 may similarly be arrayed symmetrically with respect to the screw 27 and/or the cylinders 5.

Figure 8:
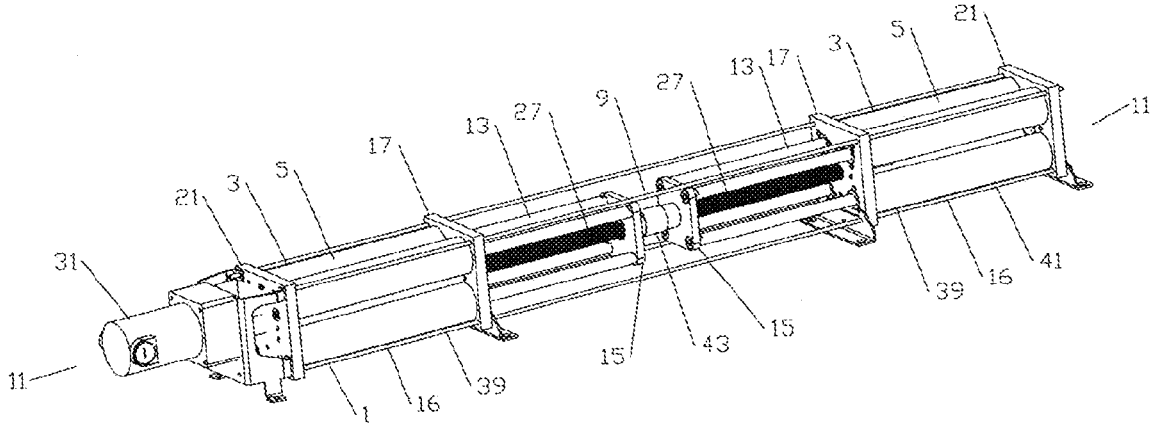
FIG. 8 is a schematic isometric view of two hydraulic power modules coupled together.
Figure 9:
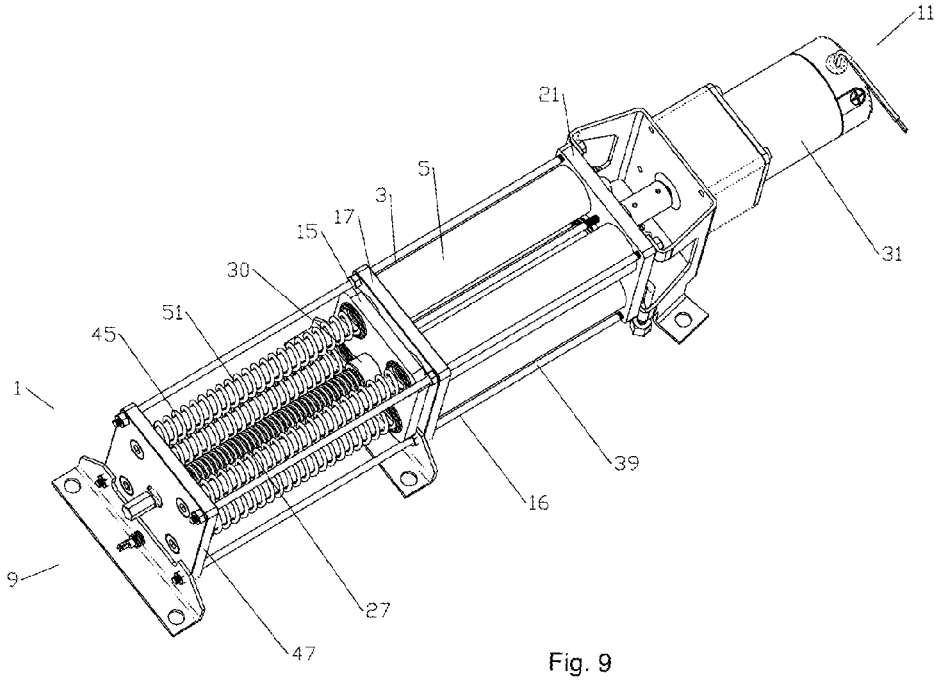
FIG. 9 is a schematic isometric angled top view of an alternative embodiment of a hydraulic power module with force balancing springs.
Figure 10:
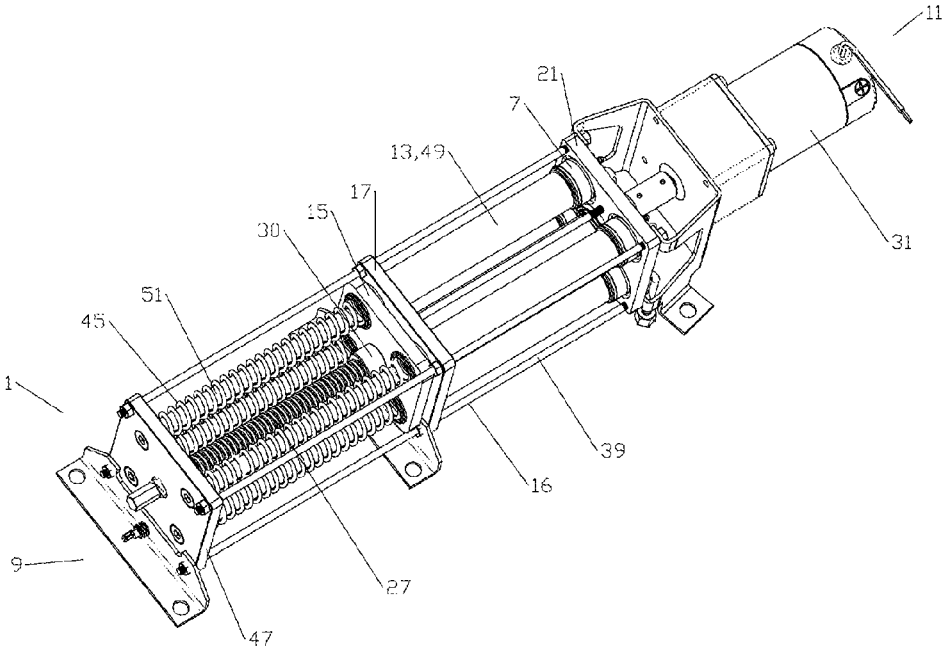
FIG. 10 is a schematic isometric angled top view of the hydraulic power module of FIG. 9 without cylinders.

In another exemplary embodiment, as shown for example in FIG. 8, the hydraulic power module 1 of the first embodiment may be coupled with a reverse acting second hydraulic power module 41 according to the first embodiment to double the number of hydraulic actuator 3 driven by a single mechanical driver, such as an electric motor 31 or reduction gear 33 driven hand crank.

The coupling between the hydraulic power module 1 and the second hydraulic power module 41 may be provided by coupling the screw 27 of the hydraulic power module 1 with the screw 27 of the second hydraulic power module 41, whereby the screws 27 are rotationally interlocked. For example, a first end 9 of the screw 27 of the hydraulic power module 1 may be coupled with a first end 9 of the screw 27 of the second hydraulic power module 41 via a drive coupler 43. The hydraulic power module 1 and the second hydraulic power module 41 may be provided with additional coupling via a plurality of compression bolts 39 coupled with the connection plate 17 of the hydraulic power module 1 and the connection plate 17 of the second hydraulic power module 41. To drive the drive plate 15 of the hydraulic power module 1 and a drive plate 15 of the second hydraulic power module 41 in opposite directions, thus simultaneously actuating the hydraulic actuators 3 of the hydraulic power module 1 and the hydraulic actuators 3 of the second hydraulic power module 37, the screw 27 of the reverse acting second hydraulic module 41 may be reverse threaded relative to the screw 27 of the hydraulic power module 1. That is, a first thread of the screw 27 rotably coupled with the drive plate 15 is reversed with respect to a second thread of the second screw 27.

One skilled in the art will appreciate that torque loads transmitted to the drive plate 15 of each hydraulic power module 1, 41 will be balanced where the two hydraulic power modules operate in opposite directions. Alternatively, the hydraulic power module 1 may be coupled with one or more second hydraulic module 41 first end 9 to second end 11.

In an alternative exemplary embodiment, as shown for example in FIGS. 9-13, a plurality of springs 45 may be applied to provide mechanical force to assist the hydraulic actuators 3 against a predetermined load upon the hydraulic actuators 3. More specifically, for example, the springs 45 may be dimensioned to provide a force sufficient to balance a predetermined load for movement by the hydraulic power module 1. When balanced with a load equal to the combined force of the compressed springs 45, force upon the drive plate 15 will be neutral, allowing the pistons 7 to be actuated with minimal torque application to the screw 27.

Figure 11:
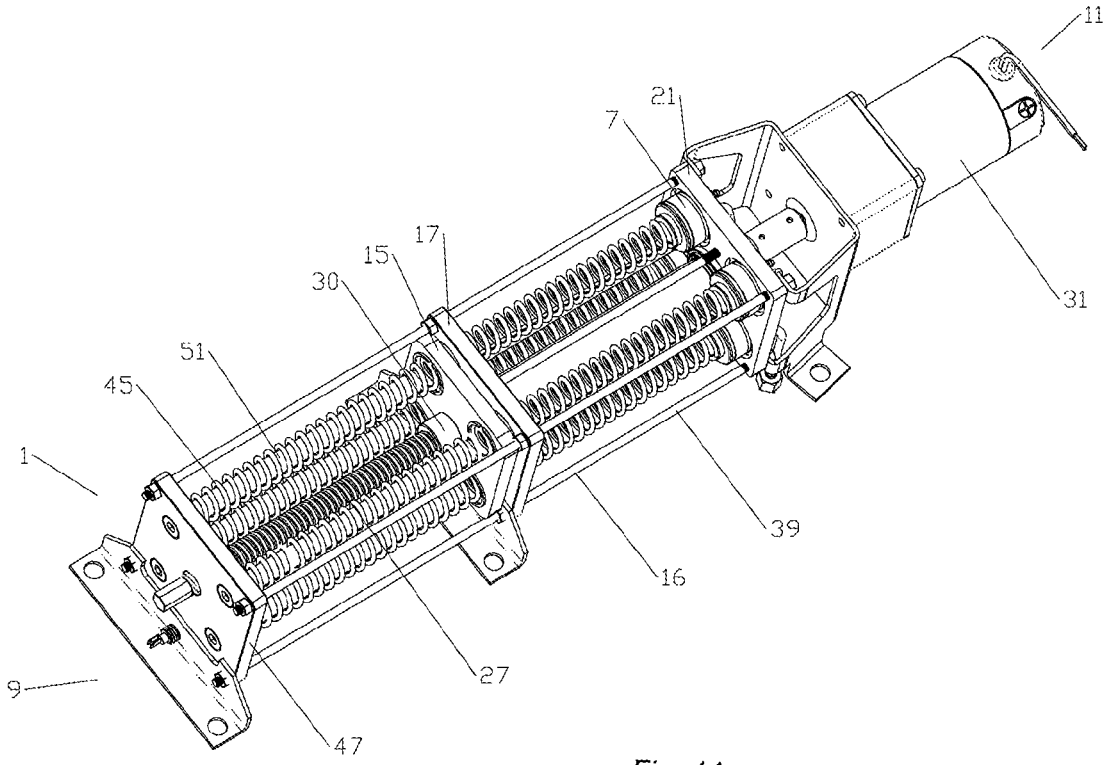
FIG. 11 is a schematic isometric angled top view of the hydraulic power module of FIG. 10 without piston tubes.

As best shown in FIG. 11, a second end 11 of each of the springs 45 may be coupled with one of the pistons 7; and a first end 9 of each of the springs 45 may be coupled with a spring retainer plate 47. The springs 45 may be inserted through the drive plate 15 and the connection plate 17.

Figure 12:
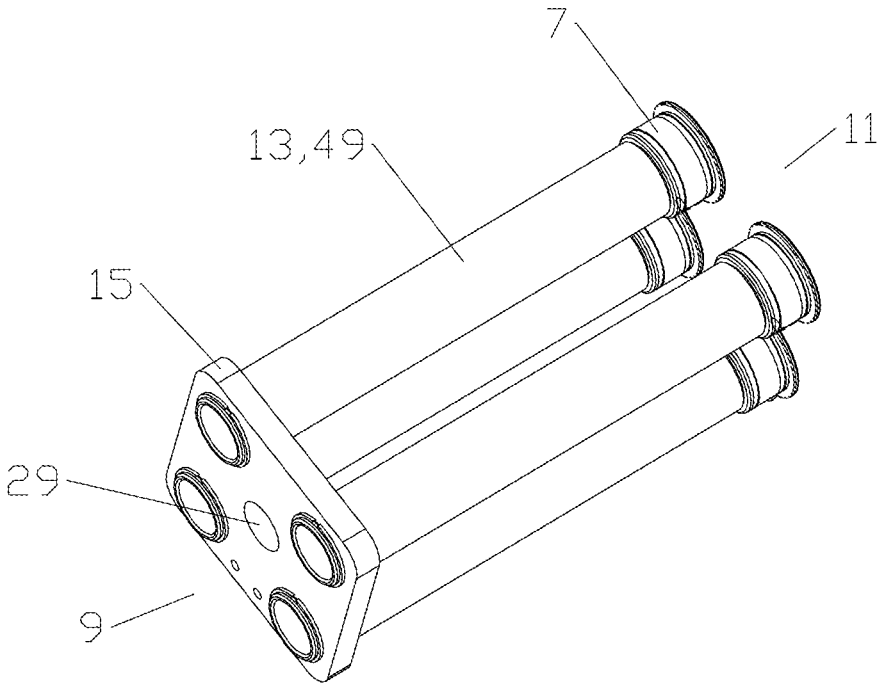
FIG. 12 is a schematic isometric view of the pistons, piston tubes and drive plate of the hydraulic power module FIG. 9.
Figure 13:
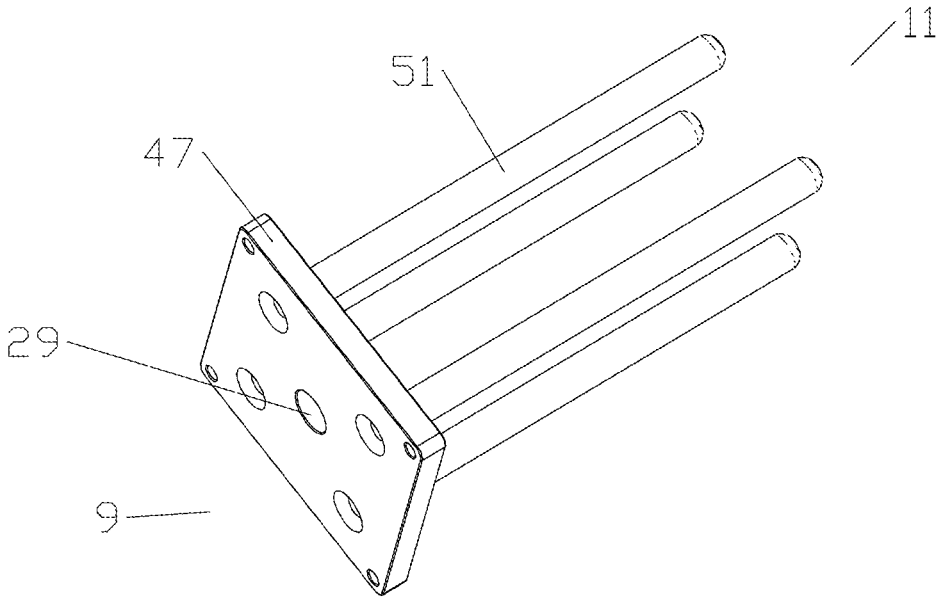
FIG. 13 is a schematic isometric view of the spring retainer plate and spring guides of the hydraulic power module of FIG. 9.

As best shown in FIG. 12, each of the pistons 7 may be coupled with the drive plate 15 via shaft 13 dimensioned as a piston tube 49 with an inner sidewall. Thereby, a portion of each of the springs 45 may be retained within an inner sidewall of one of the piston tubes 49. As best shown in FIG. 11, a first end of a plurality of spring guides 51 (see FIG. 13) may be coupled with the spring retainer plate 47, extending within and longitudinally stabilizing the portion of each spring 45 outside of the piston tubes 49. The spring retainer plate 47 may be coupled with the connection plate 17 via, for example, compression bolts 39.

In a method of manufacturing the hydraulic power module 1 of the first embodiment, a plurality of hydraulic actuators 3 coupled with a drive plate 15 are provided. A screw 27 is rotatably coupled with, for example, the drive plate 15, whereby rotation of the screw 27 longitudinally displaces the drive plate 15 longitudinally along the screw, simultaneously actuating the hydraulic actuators 3. An electric motor 31 may be coupled with, for example, a second end 11 of the screw 27. For stability, the electric motor 31 may also be coupled with the base plate 21. Bearings (not shown) may be provided to support the screw 27 at the connection and base plates 17, 21.

The actuator housing assembly 16 of the hydraulic power module 1 may be manufactured by providing several cylinder 5, for example cut from lengths of seamless pipe. The ends of the cylinder 5 are seated within respective connection plate and base plate cylinder grooves 23, 25 of the connection and base plates 17, 21 and compression bolts 39 applied to retain the connection and base plates 17, 21 biased towards one another, sealing the cylinder 5 there between.

One skilled in the art will appreciate the several advantages provided by the invention. Simultaneous actuation of the separate hydraulic actuators 3 enables greatly simplified hydraulic system layout, for example a direct action closed hydraulic path between each hydraulic actuator 3 and a desired remotely connected hydraulic actuator may be applied, wherein as the hydraulic actuator 3 is extended or retracted by the rotation of the screw 27, the remotely connected hydraulic actuator also extends or retracts without any requirement for a hydraulic circulation/return loop. To aid with retraction, the remotely connected hydraulic actuators may be oriented such that retraction is aided by force of gravity upon the hydraulic actuator and any load thereupon. When applied to multiple hydraulic actuators 3, for example, this characteristic enables greatly simplified high load capacity lift systems for objects of varied dimensions, the associated plurality of remotely connected hydraulic actuators arranged to evenly simultaneously lift the desired object.

Because rotation of the screw 27 may be driven by common electric motors, or even manually via a hand crank applied to a reduction gear 33, the hydraulic power module 1 entirely eliminates the prior requirement for a conventional on-demand hydraulic and/or pneumatic pressure supply system, and therefore has reduced physical space and total weight characteristics. Further, as the hydraulic path is greatly simplified, the number of required hydraulic path interconnections, each representing a potential leak/failure point, is reduced, resulting in improved system reliability. Also, should damage to a single hydraulic path occur, such damage effects the operation of only the associated remotely connected hydraulic actuator, not the entire hydraulic system as each of the hydraulic paths coupled with each hydraulic actuator 3 may be entirely isolated from one another. Still further, because power is not required to continuously circulate hydraulic fluid around a hydraulic reservoir and circulation loop, power may only be consumed during actuator actuation, that is, power is only consumed when the screw 27 is rotated, resulting in lowered operation costs.

The actuator housing assembly 16 may be manufactured with greatly simplified surface machining operations with significantly reduced material waste to fabricate the several plates and simple cut portions of commonly available precision dimension tubing, instead of high precision deep bore machining operations performed on a large monolithic metal block. Further, the actuator housing assembly 16 may be entirely disassembled for exchange of any elements that may become worn or otherwise damaged.

Table of Parts

| | |
|---|---|
| 1 | hydraulic power module |
| 3 | hydraulic actuators |
| 5 | cylinder |
| 7 | piston |
| 9 | first end |
| 11 | second end |
| 13 | shaft |
| 15 | drive plate |
| 16 | actuator housing assembly |
| 17 | connection plate |
| 19 | connection plate aperture |
| 21 | base plate |
| 23 | connection plate cylinder grooves |
| 25 | base plate cylinder grooves |
| 27 | screw |
| 29 | screw aperture |
| 30 | drive nut |
| 31 | electric motor |
| 33 | reduction gear |
| 35 | output port |
| 37 | output port aperture |
| 39 | compression bolt |
| 41 | second hydraulic power module |
| 43 | drive coupler |
| 45 | spring |
| 47 | spring retainer plate |
| 49 | piston tube |
| 51 | spring guide |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A hydraulic power module with a first end and a second end, comprising:

a plurality of hydraulic actuators;

a piston of each of the hydraulic actuators coupled with a drive plate; and a screw rotatably coupled with the drive plate;

each of the hydraulic actuators comprise a cylinder paired with a piston coupled with a second end of a shaft;

each of the shafts inserted through a connection plate;

a first end of each of the shafts coupled with the drive plate;

a first end of each of the cylinders coupled with the connection plate; and a second end of each of the cylinders coupled with a base plate;

wherein the drive plate, the connection plate and the base plate are each provided with a screw aperture;

the screw passing through the screw aperture of the drive plate, the connection plate and the base plate; and the screw threadably coupled with the drive plate, whereby rotation of the screw longitudinally displaces the drive plate to simultaneously actuate each of the hydraulic actuators.

2. The hydraulic power module of claim 1, further including an electric motor operable to rotate the screw.

3. The hydraulic power module of claim 1, wherein the hydraulic actuators are arranged symmetrically around the screw.

4. The hydraulic power module of claim 1, further including a plurality of springs retained between the pistons and a spring retainer plate, the plurality of springs biasing the pistons toward the second end.

5. The hydraulic power module of claim 4, further including a plurality of spring guides;

each of the spring guides inserted through a portion of one of the springs along a longitudinal axis; and a first end of each of the spring guides coupled with the spring retainer plate.

6. The hydraulic power module of claim 1, further including a second hydraulic power module according to claim 1; and the screw of the hydraulic power module coupled with a screw of the second hydraulic power module, whereby rotation of the screw of the hydraulic power module rotates a screw of the second hydraulic power.

7. The hydraulic power module of claim 5, wherein the hydraulic power module is coupled with the second hydraulic power module via a plurality of compression bolts; and the compression bolts coupled between a connection plate of the hydraulic power module and a connection plate of the second hydraulic power module.

8. The hydraulic power module of claim 5, wherein the hydraulic power module and the second hydraulic power module are arranged with the first end of the hydraulic power module facing a first end of the second hydraulic power module; and the screw of the second hydraulic power module is reverse threaded relative to the screw of the hydraulic power module.

9. The hydraulic power module of claim 1, wherein;

the screw is threadably coupled with the base plate.

10. The hydraulic power module of claim 1, further including at least one compression bolt; and the at least one compression bolt coupled between the base plate and the connection plate, retaining the cylinders therebetween.

11. The hydraulic power module of claim 1, wherein the connection plate is provided with a plurality of connection plate cylinder grooves; and the first end of each of the cylinders seating against the connection plate cylinder grooves.

12. The hydraulic power module of claim 1, further including a plurality of springs; a second end of each of the springs coupled with one of the pistons;

a first end of each of the springs coupled with a spring retainer plate;

the shafts dimensioned as piston tubes;

each of the pistons coupled with the drive plate via one of the piston tubes;

each of the springs inserted though the connection plate and the drive plate;

a portion of each of the springs within an inner sidewall of one of the piston tubes.

13. The hydraulic power module of claim 12, wherein the spring retainer plate is coupled with the connection plate via at least one compression bolt.

14. The hydraulic power module of claim 1, wherein the base plate is provided with a plurality of base plate cylinder grooves; and the second end of each of the cylinders seating against the base plate cylinder grooves.

15. The hydraulic power module of claim 14, wherein the base plate is provided with a plurality of output port apertures; at least one of the output port apertures within a circumference of each of the base plate cylinder grooves.

16. A method of manufacturing a hydraulic power module, comprising the steps of:

providing a plurality of hydraulic actuators coupled with a drive plate; and rotatably coupling a screw with the drive plate;

each of the hydraulic actuators comprise a cylinder paired with a piston coupled with a second end of a shaft;

each of the shafts inserted through a connection plate;

a first end of each of the shafts coupled with the drive plate;

a first end of each of the cylinders coupled with the connection plate; and a second end of each of the cylinders coupled with a base plate;

wherein the drive plate, the connection plate and the base plate are each provided with a screw aperture;

the screw passing through the screw aperture of the drive plate, the connection plate and the base plate; and the screw threadably coupled with the drive plate, whereby rotation of the screw simultaneously actuates the hydraulic actuators.

17. The method of claim 16, further including the step providing a plurality of springs to bias the hydraulic actuators against a predetermined load upon the hydraulic actuators.

18. The method of claim 16, further including the steps of forming an actuator housing assembly of the hydraulic actuators by providing a plurality of cylinders, a connection plate and a base plate; and retaining the plurality of cylinders between the connection plate and the base plate, via a plurality of compression bolts.

* * * * *